United States Patent [19]

Pearce

[11] 4,365,477

[45] Dec. 28, 1982

[54] COMBUSTION APPARATUS FOR GAS TURBINE ENGINES

[75] Inventor: Donald E. Pearce, Bristol, England

[73] Assignee: Rolls-Royce Limited, London, England

[21] Appl. No.: 150,366

[22] Filed: May 16, 1980

[30] Foreign Application Priority Data

May 18, 1979 [GB] United Kingdom ..... 7917335

[51] Int. Cl.[3] ..... F23R 3/30; F23R 3/50

[52] U.S. Cl. ..... 60/737; 60/756; 60/747

[58] Field of Search ..... 60/737, 738, 743, 756

[56] References Cited

U.S. PATENT DOCUMENTS

| | | | |
|---|---|---|---|
| 3,952,503 | 4/1976 | Fox et al. | 60/738 |
| 4,018,043 | 4/1977 | Clemmens | 60/756 |
| 4,085,581 | 4/1978 | Caruel et al. | 60/756 |

*Primary Examiner*—Robert E. Garrett

*Attorney, Agent, or Firm*—Stevens, Davis, Miller & Mosher

[57] ABSTRACT

Combustion apparatus for gas turbine engines has a combustion chamber (4,5) provided with fuel/air mixture injection devices (11) in an upstream end wall (9,10) of the chamber. Each device has a passage (17) having inlets (12,15) for air and fuel which mix in the passage and discharge through an outlet (19) initially in a direction along the adjacent surface of said chamber end wall (9,10). The latter wall has a secondary inlet (20) admitting a stream of air transversely to the flow from the passage outlet (19) thereby to generate an oblique flow (19A) having a component movement (Y) away from the combustion chamber wall. This directs inflammable mixture away from the latter wall and simultaneously assists mixing of air and fuel. A cooling film (24,24A) passing along the chamber wall passes over the passage wall (16) and, in certain examples, between the oblique flow and the chamber wall.

9 Claims, 11 Drawing Figures

Figure 3:
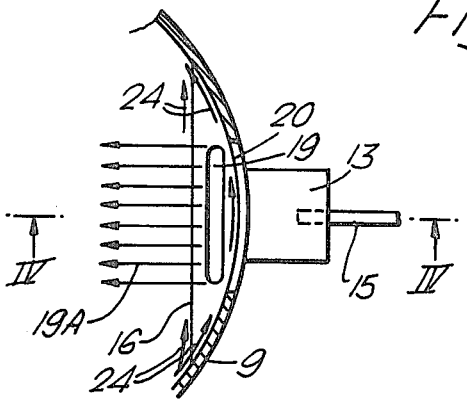

Fig. 1.
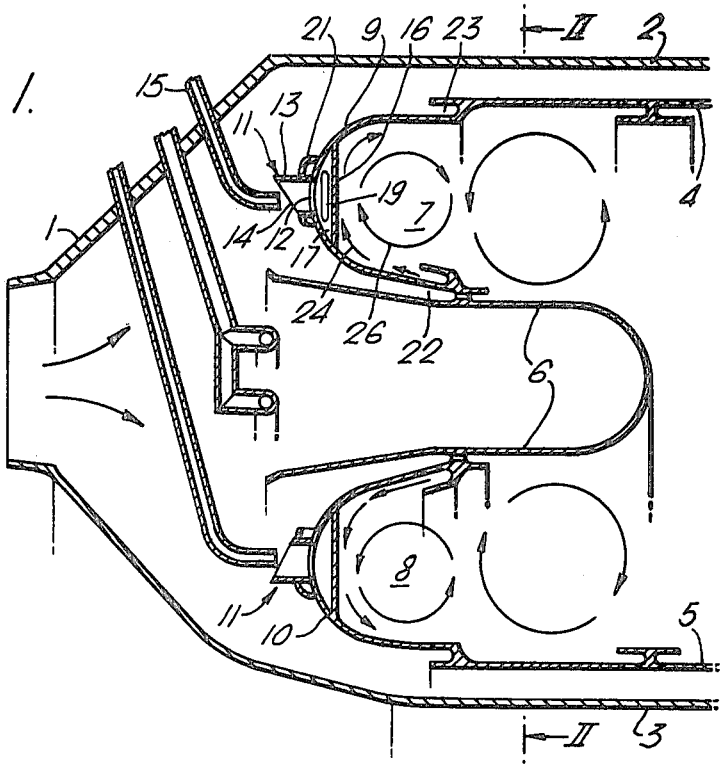
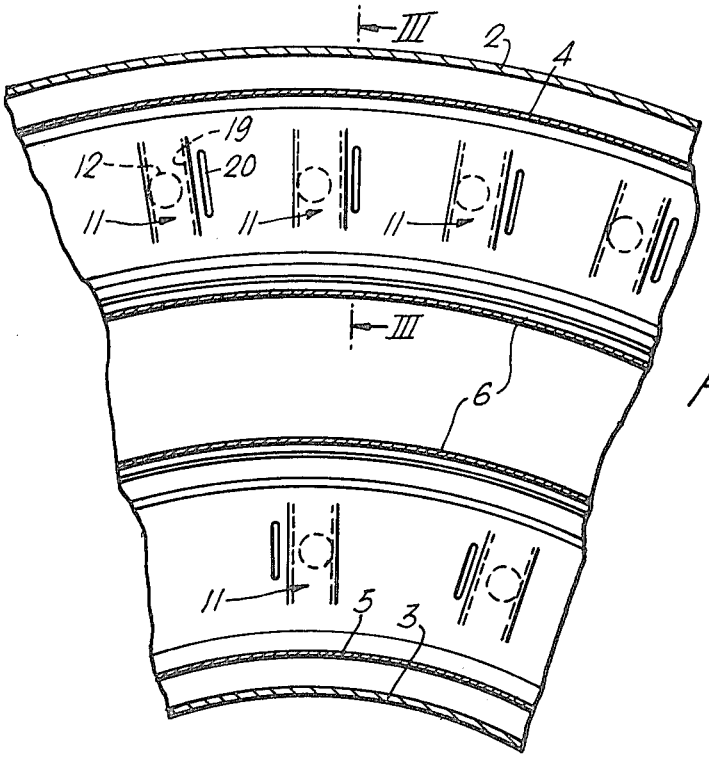
Fig. 2.

COMBUSTION APPARATUS FOR GAS TURBINE ENGINES

This invention relates to combustion apparatus for gas turbine engines.

It is known in such apparatus to provide a combustion chamber arranged in an air jacket and having an upstream end wall provided with first and second inlet passages for air. Fuel is injected into the first passages to produce a primary fuel-air mixture therein. As the mixture leaves the first passages inside the chamber it mixes with air entering the chamber through the second passages. The resulting secondary mixture is caused to circulate in the upstream end portion of the chamber to further improve mixing before entering the main part of the chamber. During said circulation the mixture comes into contact with and is ignited by flame existing in said main part. It may occur in certain circumstances of operation, especially during idling, that the flame extends upstream into contact with said wall. Since the secondary mixture is still relatively fuel-rich (in the main part further air is added to result in a leaner mixture) its consequent high burning temperature may cause destructive overheating of said end wall of the chamber. The same applies to any walls defining said passages insofar as the latter walls face the interior of the chamber.

It has been suggested in our German Offenlegungsschrift No. 2821680 to position the first passages, which necessarily must have some length to allow establishment of the primary mixture, so that their walls lie predominantly parallel to the adjacent portion of the chamber wall. This reduces the extent of projection of the passage walls into the chamber and therefore reduces the possibility of contact with the flame. The second passages were interdigitated with the first passages to cool any passage walls still exposed to the possibility of overheating. In this arrangement the outlets from both the first and the second passages necessarily had the same direction of flow. As a result it was difficult to produce good mixing of the flows from the first and second passages. Also the design was relatively inflexible as regards promoting satisfactory said circulation. It is an object of this invention to reduce or overcome these difficulties.

According to this invention there is provided combustion apparatus for gas turbine engines, comprising a combustion chamber having an end wall, first passages provided in said wall for introducing a primary fuel-air mixture into the chamber, second passages provided in said wall for introducing unfuelled air into the chamber, the first passages each having an outlet positioned to direct flow into the chamber in a direction predominantly parallel to the adjacent portion of said wall, characterized in that a said second passage is situated in proximity with each said outlet and in a position to direct air flow across the flow of primary mixture from the outlet so that the flows from adjacent said first and second passages combine to produce a flow of secondary mixture whose direction has a component away from said end wall of the chamber.

By virtue of said component direction the secondary mixture passes clear of said chamber wall and is not, or is less likely to, ignite at the latter wall with destructive effects thereon. Simultaneously, the interaction between the mutually transverse flows from the first and second passages produces good mixing of these flows with consequential benefit for combustion efficiency. Further, there is generally no limitation as regards the direction of the outlets relative to the axis of the axisymmetric arrangement of the apparatus.

Insofar as the flow from the second passages is no longer available to cool the walls of the passages, means are provided for passing a cooling film of air along the wall of the chamber and over the walls of the first passages. The secondary mixture, being directed away from the chamber wall, must necessarily penetrate the cooling film but it has been found that this penetration is essentially local and does not result in undue disruption of that film.

Figure 4:
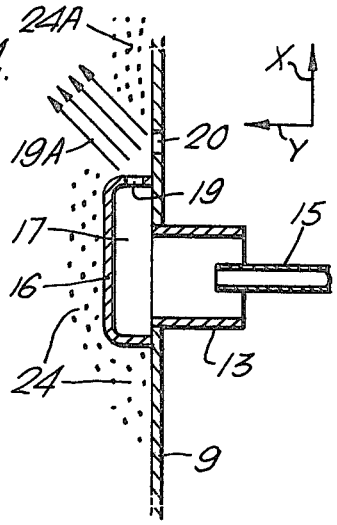
Figure 5:
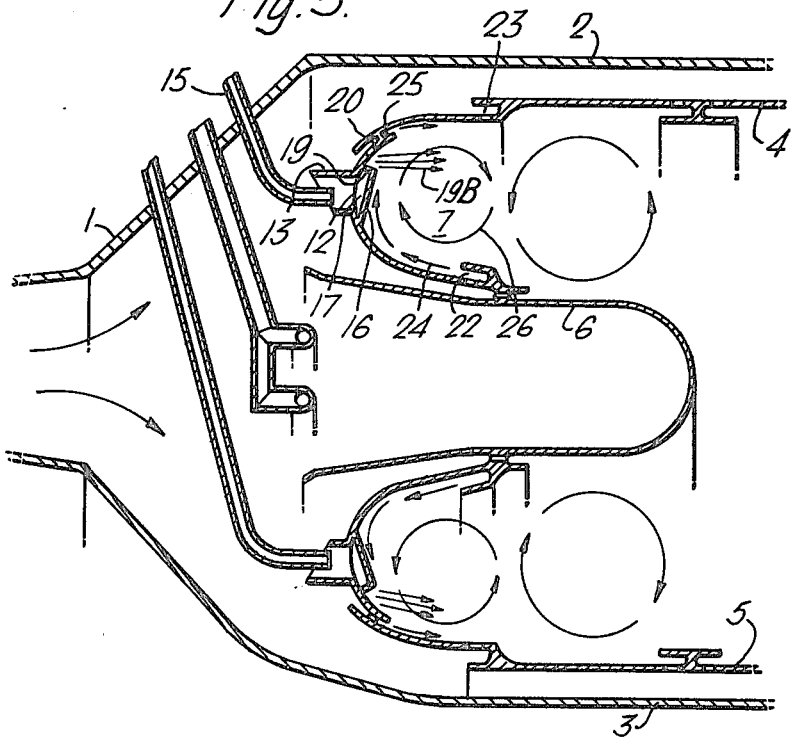
Figure 6A:
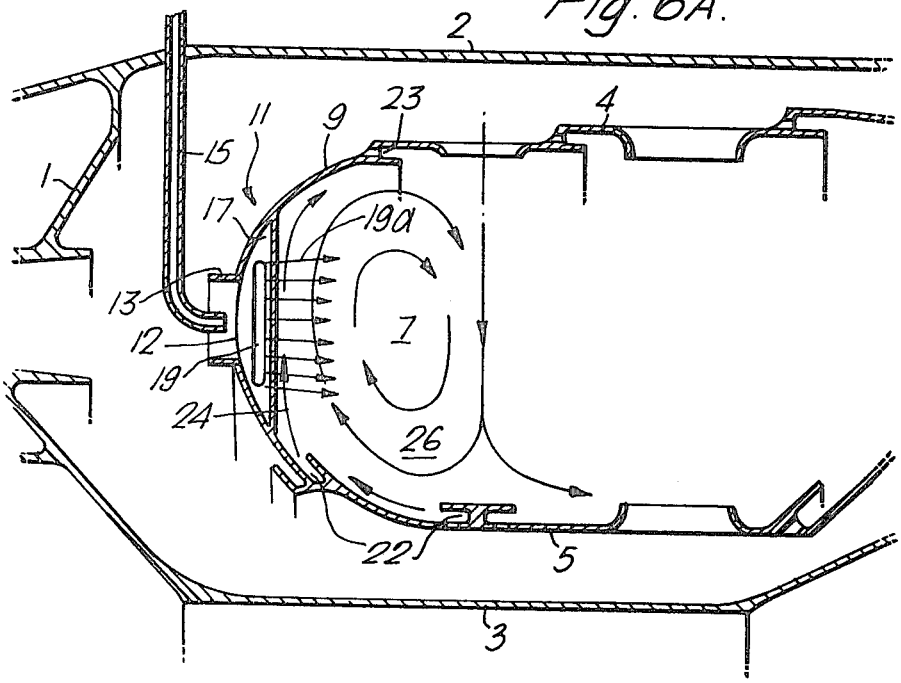
Figure 6B:
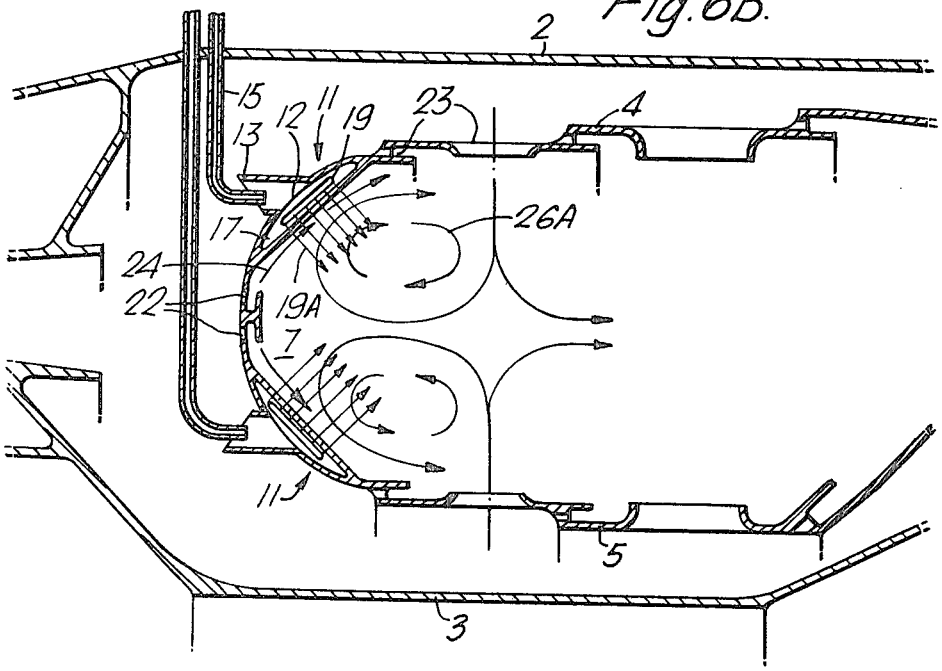
Figure 6C:
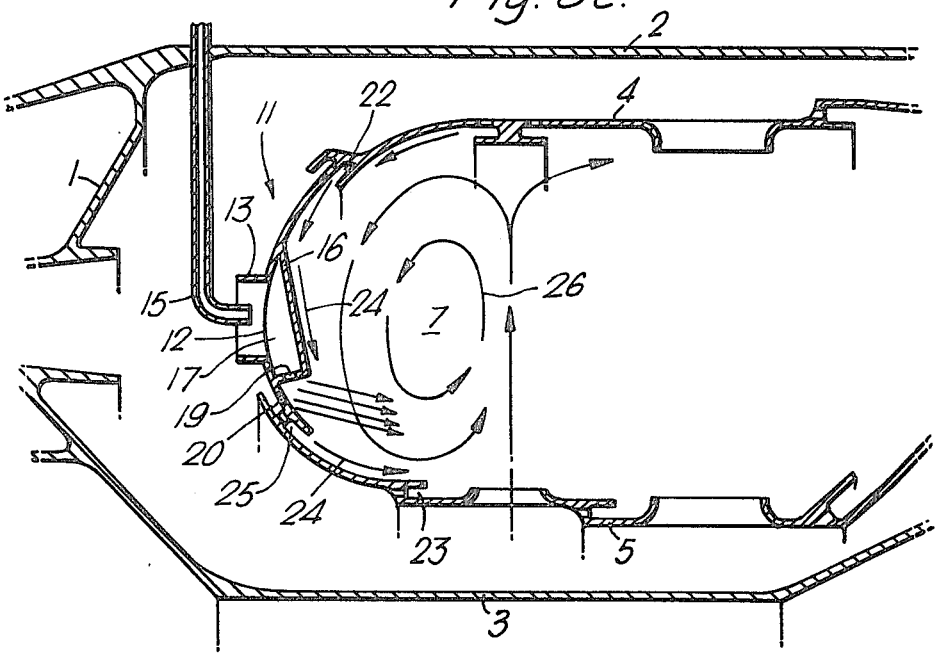
Figure 6D:
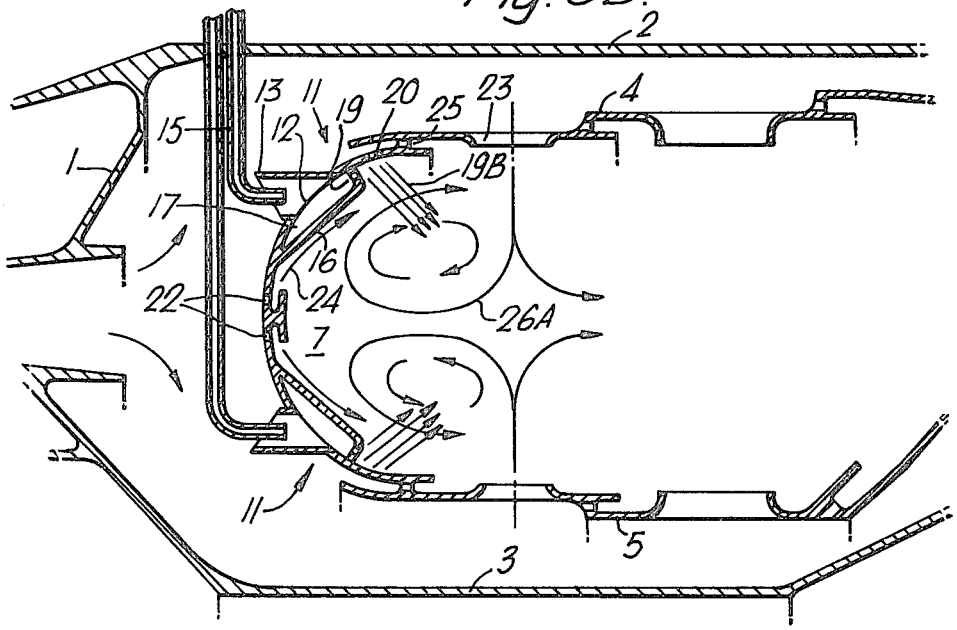
Figure 7:
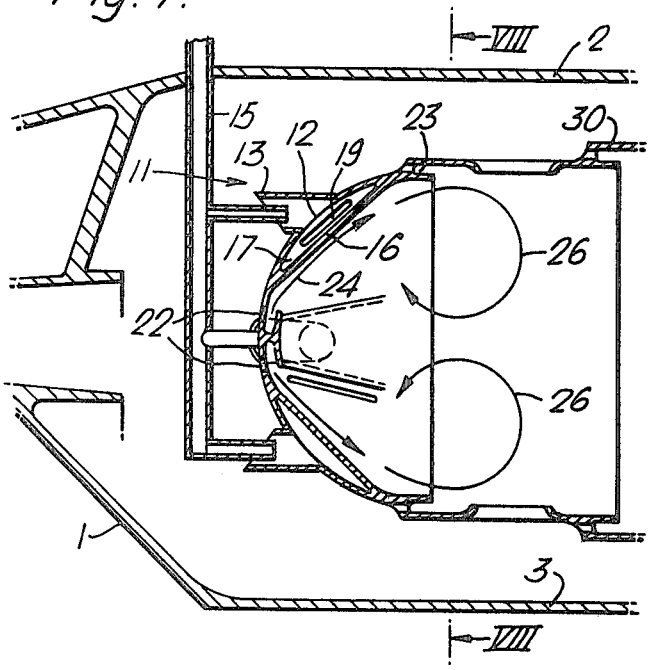
Figure 8:
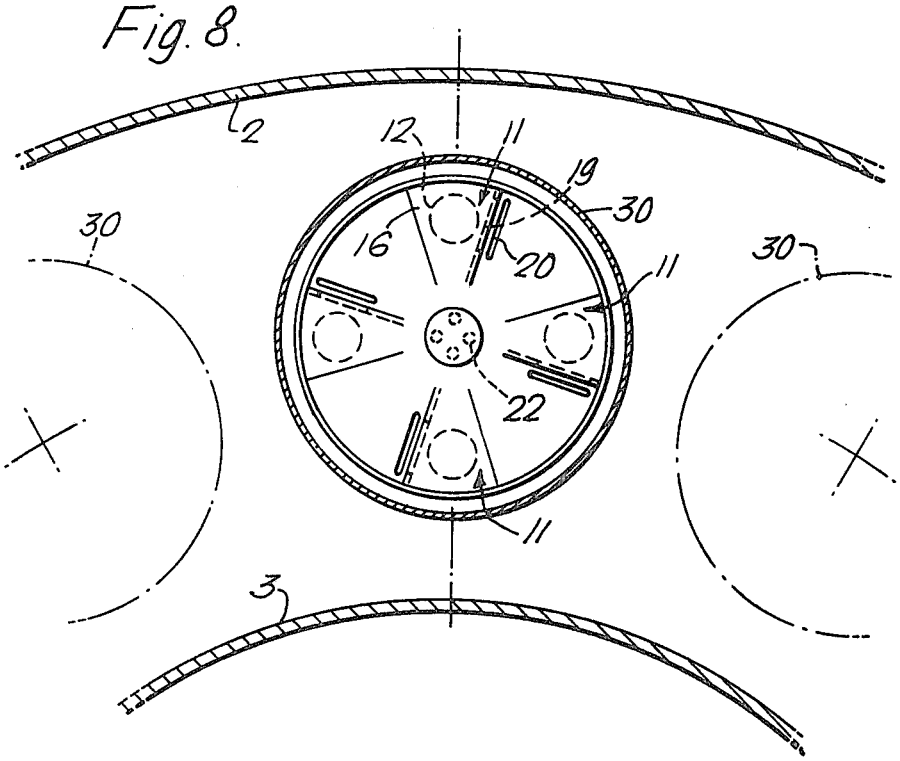

Examples of this invention will now be described with reference to the accompanying drawings wherein:

FIG. 1 is a sectional elevation of an annular combustor of a gas turbine engine, FIG. 2 is a section on the line II—II in FIG. 1 and shows a part of the annulus defined by the combustor, FIG. 3 is a section on the line III—III in FIG. 2, FIG. 4 is a cross section on the line IV—IV in FIG. 3, FIG. 5 is a cross section similar to FIG. 1 but showing a modification, FIGS. 6A–D are views similar to FIG. 1 but showing further modifications, FIGS. 7 and 8 are views similar to FIGS. 1 and 2, and illustrate the application of the invention to a combustor having an annular array of individual combustion tubes.

In the drawings the same reference numerals are used throughout to indicate the same or corresponding component parts of the different illustrated embodiments.

FIGS. 1 and 2 show part of an annular combustor of a gas turbine engine which receives compressed air through a diffuser duct 1 from a compressor (not shown). The combustor has an air jacket 2,3 containing walls 4,5 defining between them an annular combustion chamber having at its upstream end two concentric annular pilot zones 7,8 separated by an annular centre body 6.

Each of the annular pilot zones 7,8 receives fuel-air mixture from a number of mixture injectors arranged in spaced apart relationship around an annulus defined by half-toroidal upstream end walls 9,10 of the respective zones 7,8. Each injector is indicated generally by reference numeral 11 in FIGS. 1 and 2 and has the construction shown, on an enlarged scale, in FIGS. 3 and 4.

Each injector 11 has a primary air inlet aperture 12 in the upstream end wall 9,10 of the associated zone 7,8 for the admission of compressed air direct from the diffuser duct 1 through an associated air inlet tube 13 which projects a short distance in an upstream direction from the outside of the associated end wall 9,10. In the twin pilot zone arrangement shown in FIGS. 1 and 2 the air inlet tubes 13 are provided with scarfed air intakes 14 which face in the direction of the compressed air flow from the diffuser duct 1.

A fuel injection pipe 15 extends coaxially into the air inlet tube 13 and terminates adjacent the intake end of the inlet tube 13, as shown in FIGS. 3 and 4, for the purpose of directing liquid, gaseous or solid pulverulent fuel axially through the centre of the aperture 12. The pipes 15 may communicate with any convenient arrangement of fuel supply lines and manifolds (not shown).

The generating curve of the half-toroidal wall 9,10 is concave to the interior of the chamber 4,5. At each injector 11 a flat wall 16 is secured chordally across the wall 9,10 and defines therewith a first passage 17 with which the aperture 12 communicates. The wall 16 faces the aperture 12. The passage 17 has an outlet in the form of a slot 19 having a flow direction along the wall 9,10 which is tangential in respect of the annulus of the wall 9,10 and which is directed toward the next adjacent injector 11. The slot 19 is elongate in a direction substantially parallel to the internal surface of the combustion chamber end wall 9,10 so that fuel and air, after impinging upon the internal surface of the wall 16 within the passage 17, passes into the associated pilot zone 7,8 through the slot 19 in the form of a fan-shaped jet of fuel-air mixture referred to as the "primary mixture".

Adjacent each slot 19 the wall 9,10 is provided with a second inlet passage 21 having an outlet in the form of a slot 20 which is elongate in a direction substantially parallel to the direction of elongation of the associated slot 19. A jet of secondary air therefore enters the pilot zone 7,8 from the diffuser duct 1 through the slot 20 so as to deflect the jet of primary mixture obliquely away from the upstream wall 9,10 as shown diagrammatically in FIGS. 3 and 4. The passage 21 may define a scoop or shroud, FIG. 1, to ensure that the slot 20 is fed by total head pressure of the compressor air rather than the static pressure of the air flowing externally over the upstream end of the combustion chamber.

The walls 4,5 are provided with air inlet apertures 22,23 in a conventional manner for the admission of cooling and combustion air, in a way generating toroidal vortices 26 about the axis of the combustion chamber. The apertures 22 are shrouded to direct the entering air in the form of a cooling film 24 along the wall 9,10 and over the surfaces of the walls 16 facing the interior of the combustion chamber, the film 24 constituting a peripheral layer of the vortex 26 passing radially in respect of the annulus axis of the walls 9,10.

In operation of the injectors 11 the impingement of the fuel and air on the internal surfaces of the wall 16 causes some atomization of the fuel and mixture of the fuel and air in the passage 17, before expulsion of the primary mixture into the associated pilot zone 7,8 through the slots 19. The jet of air entering the combustion chamber through any one slot 20 and perpendicular to the walls 9,10 intersects and mixes with the efflux from the adjacent slot 19, resulting in a thick fan-shaped flow being a jet 19A of well-atomized air-fuel mixture referred to as the "secondary mixture". Due to the interaction of the primary mixture emerging from the slot 19 and the secondary air emerging from the slot 20, the secondary mixture has, as mentioned, a direction obliquely away from the walls 9,10. In the present example the direction of the jet 19A has a component X circumferentially along the annular walls 9,10 and a component Y in the direction of the axis of the annulus of the walls 9,10. Both said components are transverse to the direction of the film 24. The resultant direction of the jet 19A is such that this jet penetrates the film 24 but since neither said component is opposed to the direction of the film 24 the penetration by the jet 19A does not significantly disrupt the film 24. This is particularly illustrated in FIG. 4 where it will be seen that the film 24 is free to enter between the jet 19A and the walls 9,10, as shown at 24A, to avoid damage to those walls due to any premature ignition of the air-fuel mixture.

An alternative arrangement of injectors 11, in the same twin pilot zone arrangement as shown in FIGS. 1,2, is shown diagrammatically in FIG. 5 where the outlet slots 19 of the injectors 11 face radially along the walls 9,10, i.e. face in a direction which is radial in respect of the annulus axis or which has at least a component which is radial in respect of that axis. In such a case the slots 19 must face in the same sense of direction as that of the flow of the film 24. The slots 20 produce, as before, a flow perpendicular to the walls 9,10 so that the jet of secondary mixture, in this case denoted 19B, has a resultant direction away from the walls 9,10 and obliquely penetrates the film 24 where the latter sweeps over the wall 16 of the respective passage 17. This means that the film 24 is locally absorbed by the jet 19B and, to re-establish the film, inlets 25 are provided adjacent the slots 20 to feed air along the walls 9,10 in the direction of the film 24. The inlets 25 also serve as shrouds for directing air toward the slots 20 as shown.

FIGS. 6A to 6D show different configurations of the injectors 11 according to the invention in an annular combustion chamber using single rows of devices 11 (FIGS. 6A and 6c) and double rows of devices 11 (FIGS. 6B and 6D). Correspondingly the apertures 22,23 are arranged to produce a single toroidal vortex 26 (FIGS. 6A and 6C) and double toroidal vortices 26A (FIGS. 6B and 6D), respectively.

FIGS. 7 and 8 show a combustor having an annular array of individual combustion tubes 30 each having a number of injectors 11 arranged in a manner analagous to that shown in FIGS. 1 to 6 and having a vortex 26 centred on the axis of the tube 30, FIG. 7.

I claim:

1. Combustion apparatus for gas turbine engines, comprising a combustion chamber having an end wall, first passages in said wall for introducing a primary fuel-air mixture into the chamber, the first passages each having an outlet positioned to direct flow into the chamber in a direction predominantly parallel to the adjacent portion of said wall, second passages in said wall for introducing unfuelled air into the chamber, a said second passage being situated in proximity with each said outlet and in a position to direct air flow across the flow of primary mixture from the outlet so that the flows from adjacent said first and second passages combine to produce a flow of secondary mixture whose direction has a component away from said end wall of the chamber, each said first passage having a wall facing the inside of said chamber, inlets positioned to generate a cooling film along the inside of said end wall and arranged to direct said cooling film over at least the greater part of respective said walls of said first passages.

2. Combustion apparatus according to claim 1, wherein said cooling inlets are arranged to direct said cooling film transversely to the direction of flow from said outlet of said first passage.

3. Combustion apparatus according to claim 1 wherein said first passages are arranged in spaced apart relationship around an annulus and said outlets each have a flow direction which is tangential in respect of said annulus and directed toward the next adjacent first passage.

4. Combustion apparatus according to claim 1 wherein said first passages are arranged in spaced apart relationship around an annulus and said outlets each have a flow direction at least a component of which is radial in respect of said annulus.

5. Combustion apparatus according to claims 3 or 4 wherein said combustion chamber end wall defines a curve which is concave with respect to the interior of the chamber, each said first passage is defined between the end wall and a wall extending chordally across the curve thereof, and inlets to said first passages are provided in said end wall at a flow direction transverse to said chordal wall.

6. Combustion apparatus according to claim 1 wherein said cooling inlets are positioned to direct said cooling film through between said chamber wall and the flow of said secondary mixture.

7. Combustion apparatus according to claim 3 wherein said cooling inlets are arranged to direct said cooling film radially in respect of said annulus.

8. Combustion apparatus according to claim 1 wherein said cooling inlets are arranged to direct said cooling film in the same sense of direction as that of the flow direction of said passage outlet.

9. Apparatus according to claim 1 wherein the outlets of the first passages are elongate in a direction substantially parallel to the internal surface of the end wall, the outlet of any second passage is elongate in a direction substantially parallel to the direction of elongation of the outlet of the adjacent first passage.

* * * * *